US007147503B2

(12) United States Patent
Shindo

(10) Patent No.: US 7,147,503 B2
(45) Date of Patent: Dec. 12, 2006

(54) ELECTRICAL CONNECTING DEVICE HAVING A COVER WITH A LATCH

(75) Inventor: Satoru Shindo, Osaka (JP)

(73) Assignee: J.S.T. Mfg. Co., Ltd. (JP)

( * ) Notice: Subject to any disclaimer, the term of this patent is extended or adjusted under 35 U.S.C. 154(b) by 0 days.

(21) Appl. No.: 10/962,002

(22) Filed: Oct. 8, 2004

(65) Prior Publication Data

US 2005/0079770 A1 Apr. 14, 2005

(30) Foreign Application Priority Data

Oct. 9, 2003 (JP) ..... 2003-350674

(51) Int. Cl.
*H01R 13/627* (2006.01)

(52) U.S. Cl. ..... 439/354; 439/620.05; 439/689; 439/942

(58) Field of Classification Search ..... 439/354, 439/358, 357, 689, 682, 466, 352, 620.05, 439/620.07
See application file for complete search history.

(56) References Cited

U.S. PATENT DOCUMENTS 5,314,345 A * 5/1994 Cahaly et al. ..... 439/188
5,431,578 A 7/1995 Wayne
5,591,041 A * 1/1997 Cecil et al. ..... 439/352
5,921,800 A * 7/1999 Liebich ..... 439/354
6,250,952 B1 6/2001 Shiga et al.
6,623,275 B1 9/2003 Pavlovic et al.
2003/0032321 A1 2/2003 Wertz et al.

FOREIGN PATENT DOCUMENTS

DE 297 19 332 U1 2/1999
EP 0 734 101 A2 9/1996
EP 1 193 808 A2 4/2002

* cited by examiner

*Primary Examiner*—Neil Abrams
(74) *Attorney, Agent, or Firm*—Osha Liang LLP

(57) ABSTRACT

An electrical connector comprises a male connector component supporting connecting terminals, which are electrically connected to to-be-connecting terminals of a female connector element, and a cover element attached to the male connector component to the connecting terminals. The male connector component includes a peripheral wall, which forms a cavity for a ferrite member and which includes flexible latches to restrain movement of the ferrite member. The cover element includes an outer peripheral wall adapted for fitting the peripheral wall of the male connector component. The cover element also includes a latching part disposed on an outer surface of the outer peripheral wall and expanding outward. The latching part engages with a recess formed in an opening of the female connector component when the cover element is fitted into the opening together with the male connector component.

10 Claims, 14 Drawing Sheets

ELECTRICAL CONNECTING DEVICE HAVING A COVER WITH A LATCH

TECHNICAL FIELD

The present invention relates to an electrical connecting device that has a male connector component, which supports a pair of connecting terminals, and a cover element fitted to the male connector component and that is connected to a female connector component supporting a pair of to-be-connected terminals.

BACKGROUND ART

A device disclosed in Japanese Published Unexamined Patent Application No. 2002-33153 is conventionally known as an electrical connecting device that has a male connector component, which supports a pair of connecting terminals, and a cover element fitted to the male connector component and that is connected to a female connector component supporting a pair of to-be-connected terminals. The electrical connecting device disclosed in this publication (No. 2002-33153) is a plug connector that is connected to a socket connector so as to realize an ignition circuit of a detonator of an air bag gas generator for vehicles. This electrical connecting device is made up of a connector housing (i.e., male connector component), a connector cover (i.e., cover element), and a pair of electric contacts (i.e., a pair of connecting terminals). The electrical connecting device is designed so that the connector cover is fitted to the connector housing so as to form a unit as a plug connector in a state in which the electric contact is held. The plug connector formed as a unit is fittably inserted into a socket cavity (opening) formed in the socket connector (female connector component), and is electrically and mechanically connected to the socket connector. At this time, a protruding rib provided at an arm extended from the connector housing is engaged with an engagement groove of the socket cavity, so that the socket connector and the plug connector are mechanically locked together.

However, in the electrical connecting device disclosed in Japanese Published Unexamined Patent Application No. 2002-33153, the mechanical locking between the female connector component (socket connector) and the plug connector is realized by the engagement between the protruding rib formed on the male connector component (connector housing) and the engagement groove formed in the opening (socket cavity) of the female connector component. Therefore, a conventional problem resides in the fact that when an external force acts on the electrical connecting device connected to the female connector component (e.g., when a tensile force arises in a lead wire connected to the connecting terminal, or when a blast generated by the inflation of an air bag acts thereon), the cover element (connector cover) is easily disengaged even if the male connector component is locked onto the female connector component.

DISCLOSURE OF THE INVENTION

It is an object of the present invention to provide an electrical connecting device in which a cover element is not easily disengaged even when an external force acts thereon and in which a male connector component and the cover element are firmly fitted to a female connector component.

The electrical connecting device of the present invention is concerned with an electrical connecting device connected to a female connector component supporting a pair of to-be-connected terminals. In order to achieve the object, the electrical connecting device of the present invention is characterized by comprising a male connector component that supports a pair of connecting terminals electrically connected to the pair of to-be-connected terminals and that is fitted to an opening formed in the female connector component and a cover element that is fitted to the male connector component in such a way as to sandwich the connecting terminal while covering an upper opening of the male connector component into which the connecting terminal is inserted and that is provided with a convex part that is engaged with a concave part formed in the opening when the cover element is fitted to the opening together with the male connector component.

According to this structure, since the convex part formed on the cover element is engaged with the concave part formed in the opening of the female connector component, the cover element is mechanically locked onto the female connector component and is not easily disengaged even when an external force acts thereon. Additionally, since the cover element with which the upper opening of the male connector component is covered and the female connector component are locked together, a state is reached in which the male connector component and the cover element are both locked onto the female connector component. Therefore, it is possible to obtain the electrical connecting device in which the cover element is not easily disengaged even when an external force acts thereon and in which the male connector component and the cover element are firmly fitted to the female connector component.

The aforementioned object, objects other than this object, features, and advantages of the present invention will become apparent from reading the following description with reference to the attached drawings.

BEST MODE FOR CARRYING OUT THE INVENTION

With reference to the attached drawings, a description will be hereinafter given of a best mode for carrying out the present invention. The present invention is suitable to be applied as an electrical connecting device for a squib that is ignited by applying an electric current to a gas generator in a vehicular air bag system. Although an embodiment in this case will be described, the present invention can be widely and variously applied and can be applied in many different environments and for various kinds of objects.

Figure 1:
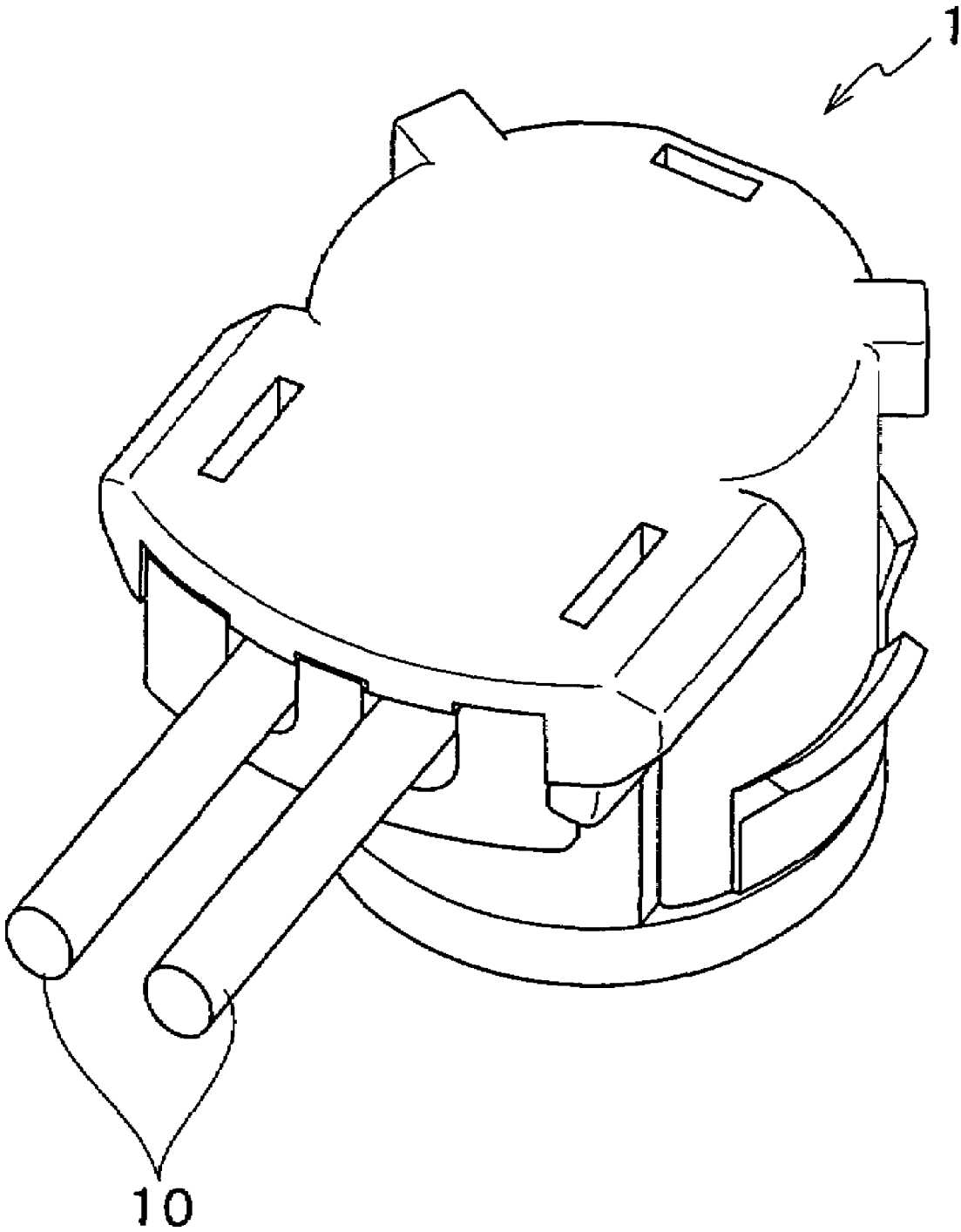
FIG. 1 is a perspective view depicting an electrical connecting device according to an embodiment of the present invention.
Figure 2:
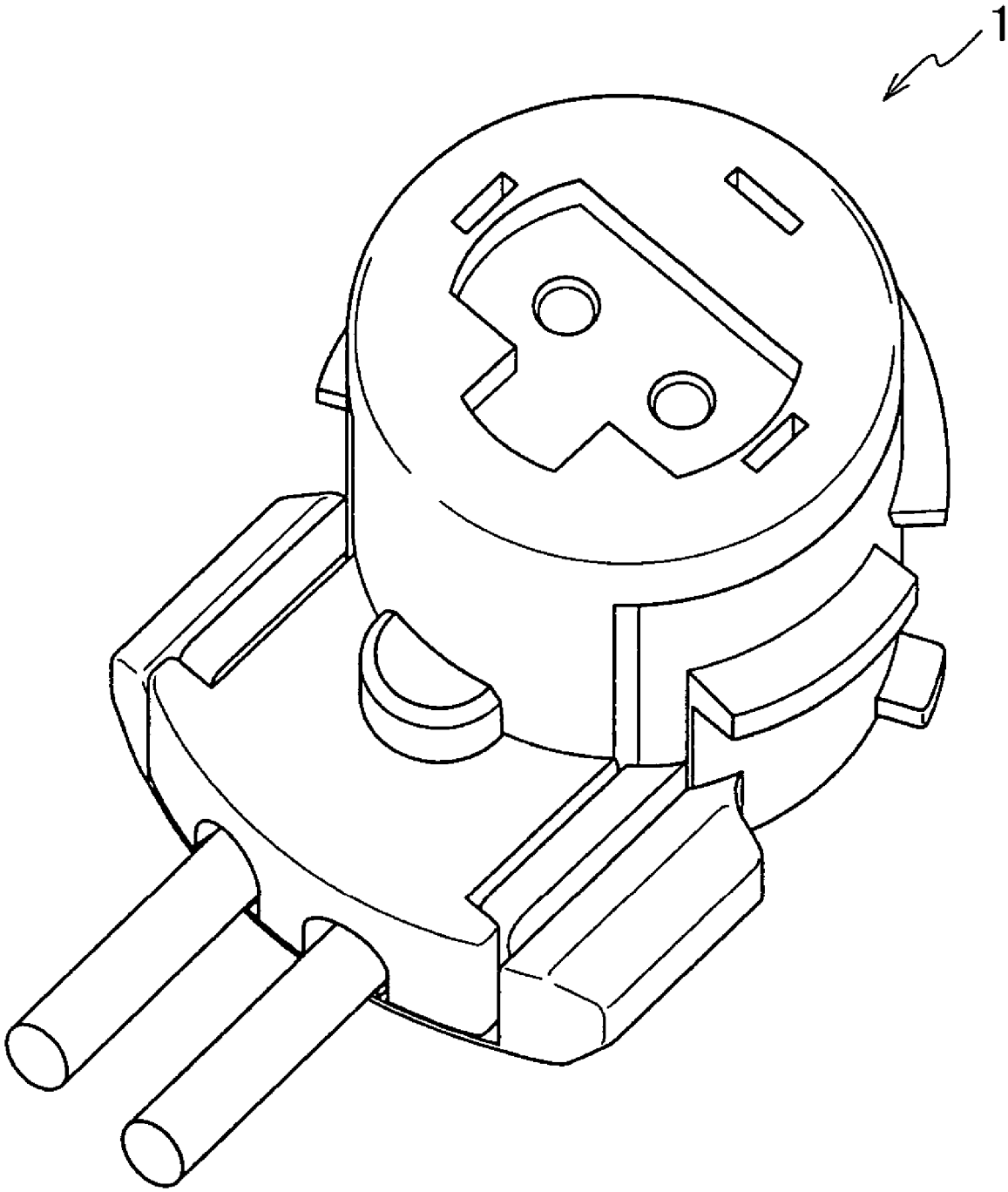
FIG. 2 is a perspective view of the electrical connecting device turned upside down from the state of FIG. 1.
Figure 3:
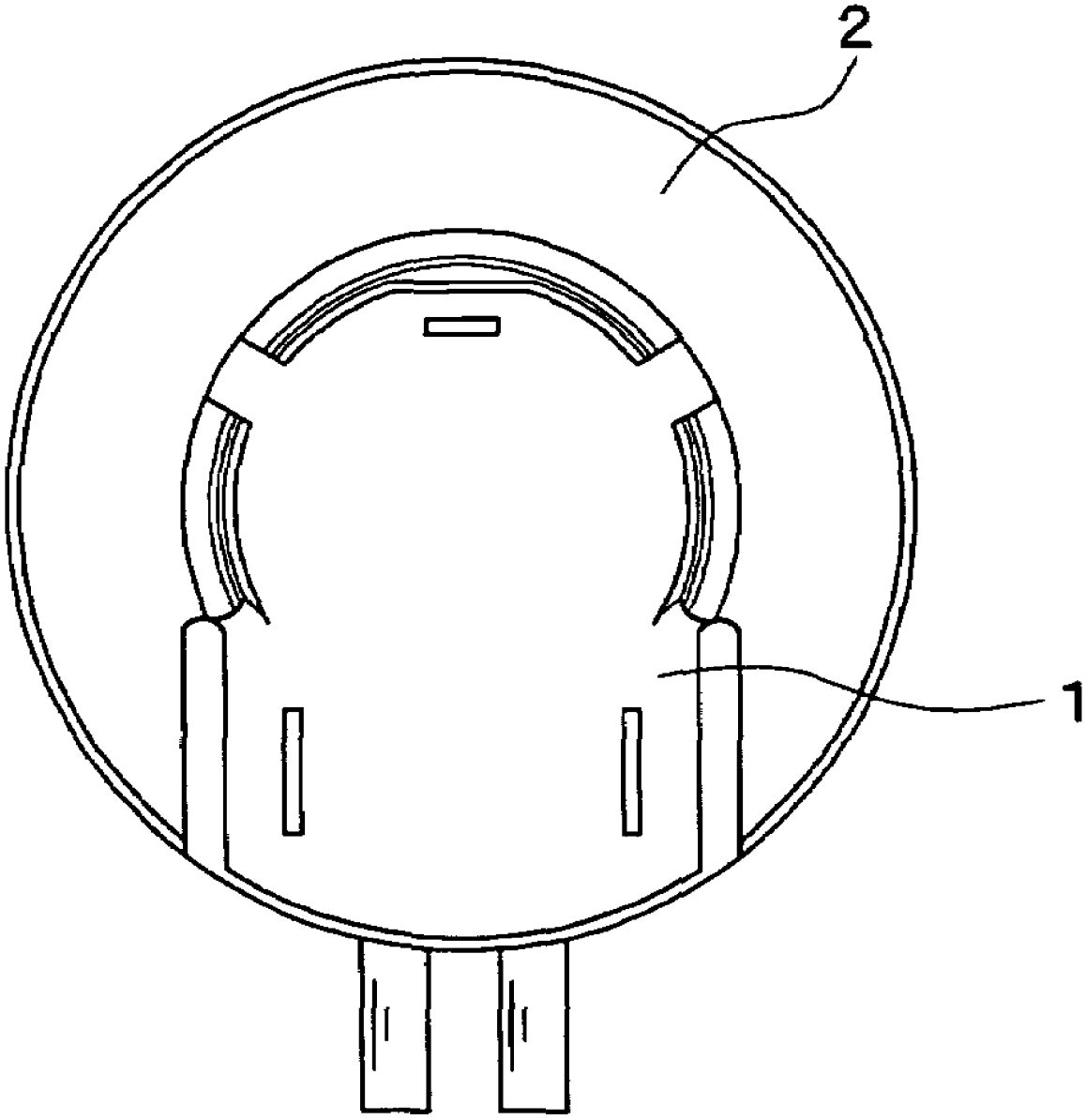
FIG. 3 is a plan view showing a state in which the electrical connecting device of FIG. 1 has been fitted and connected to a female connector component.

FIG. 1 is a perspective view of an electrical connecting device 1, seen from above, according to an embodiment of the present invention, and FIG. 2 is a perspective view of the electrical connecting device 1 turned upside down from the state of FIG. 1 (i.e., with a bottom of the electrical connecting device 1 upward). FIG. 3 is a plan view showing a state in which the electrical connecting device 1 is fitted and connected to a connector component 2 to be connected (hereinafter, referred to as a "female connector component 2"), and FIG. 4 is an exploded perspective view of the electrical connecting device 1.

As shown in FIG. 1 to FIG. 4, the electrical connecting device 1 is structured in the form of a plug that is connected to the female connector component 2 structured in the form of a socket. Lead wires 10 and 10 have their ends connected to a pair of connecting terminals 11 and 11, respectively, that are supported in the electrical connecting device 1. The other end of each of the lead wires 10 and 10 is connected to an air bag control system not shown. The female connector component 2 is provided as a part of an air bag igniting device (squib) not shown. The electrical connecting device 1 and the female connector component 2 are mechanically and electrically connected together by fitting the electrical connecting device 1 to the female connector component 2. That is, the electrical connecting device 1 and the female connector component 2 are engaged with each other, and the pair of connecting terminals 11 and 11 are brought into contact with a pair of to-be-connected terminals, respectively, that are supported by the female connector component 2. In a state in which the electrical connecting device 1 has been connected to the female connector component 2, the squib is burned by being supplied with sufficient electrical energy through the lead wires 10 and 10 in accordance with a command issued from the air bag control system. Gas generating materials are ignited by this burning, and an air bag is inflated.

Figure 12:
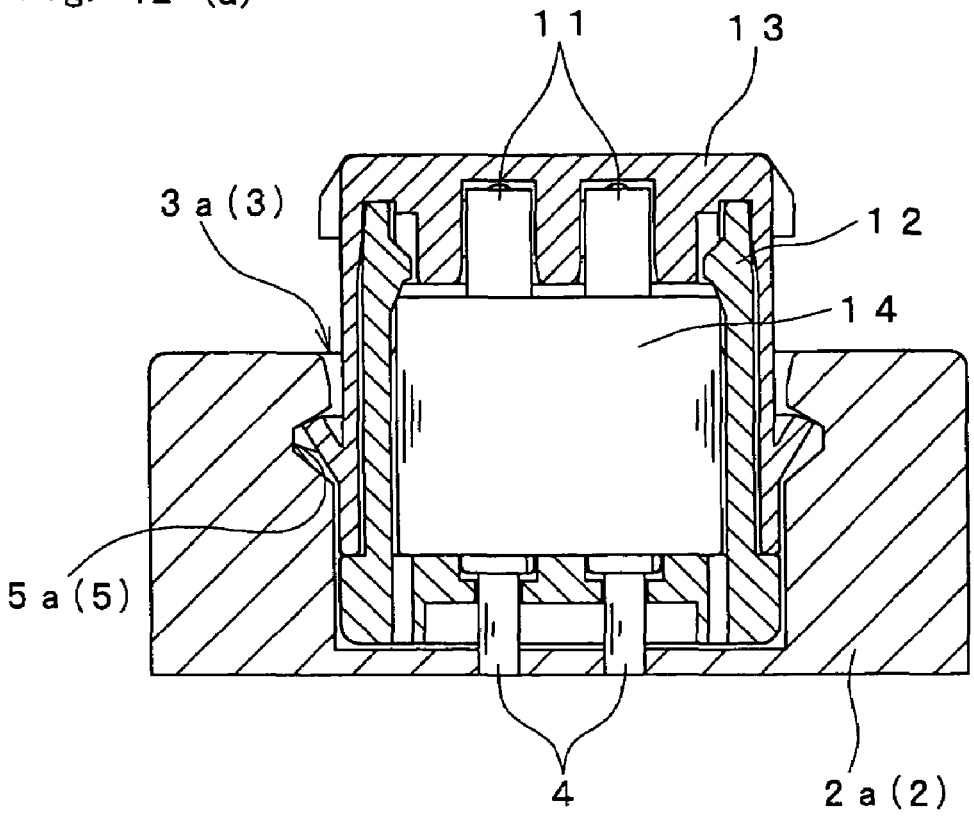
FIG. 12 is a sectional view showing a state in which the electrical connecting device has been connected to the female connector component whose engagement concave is a trapezoid type, and is a plan view of the female connector component.
Figure 12:
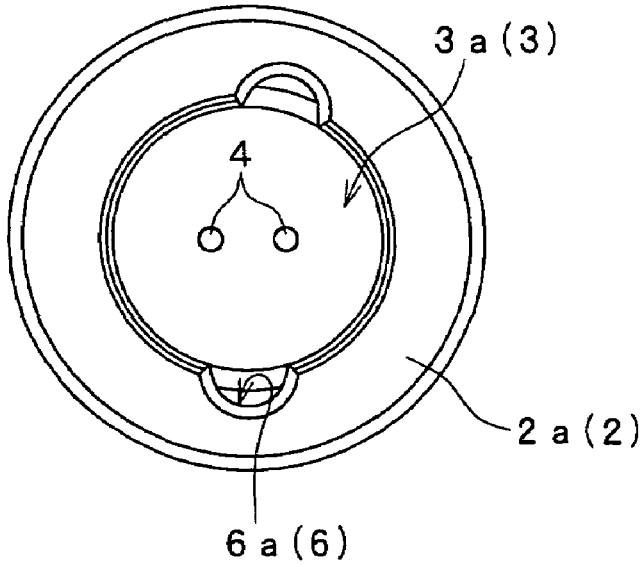
Figure 13:
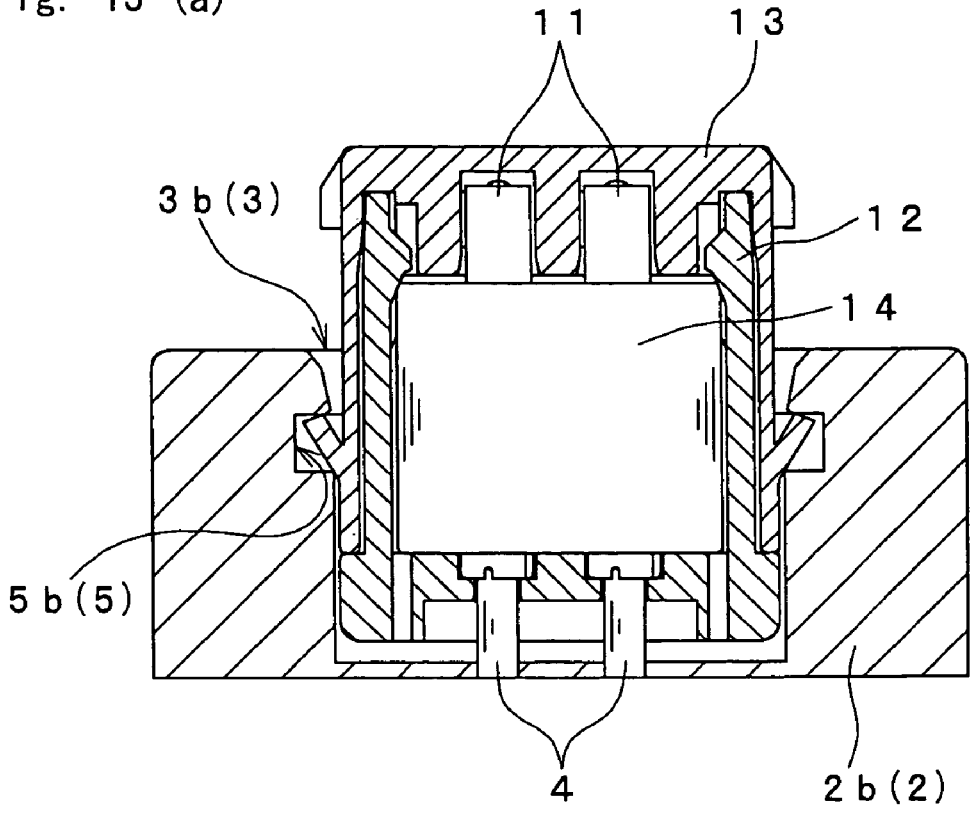
FIG. 13 is a sectional view showing a state in which the electrical connecting device has been connected to the female connector component whose engagement concave is a rectangle type, and is a plan view of the female connector component.
Figure 13:
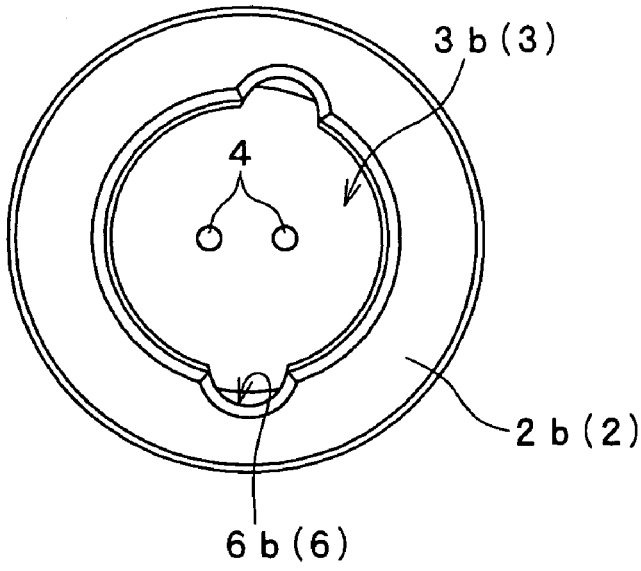
Figure 14:
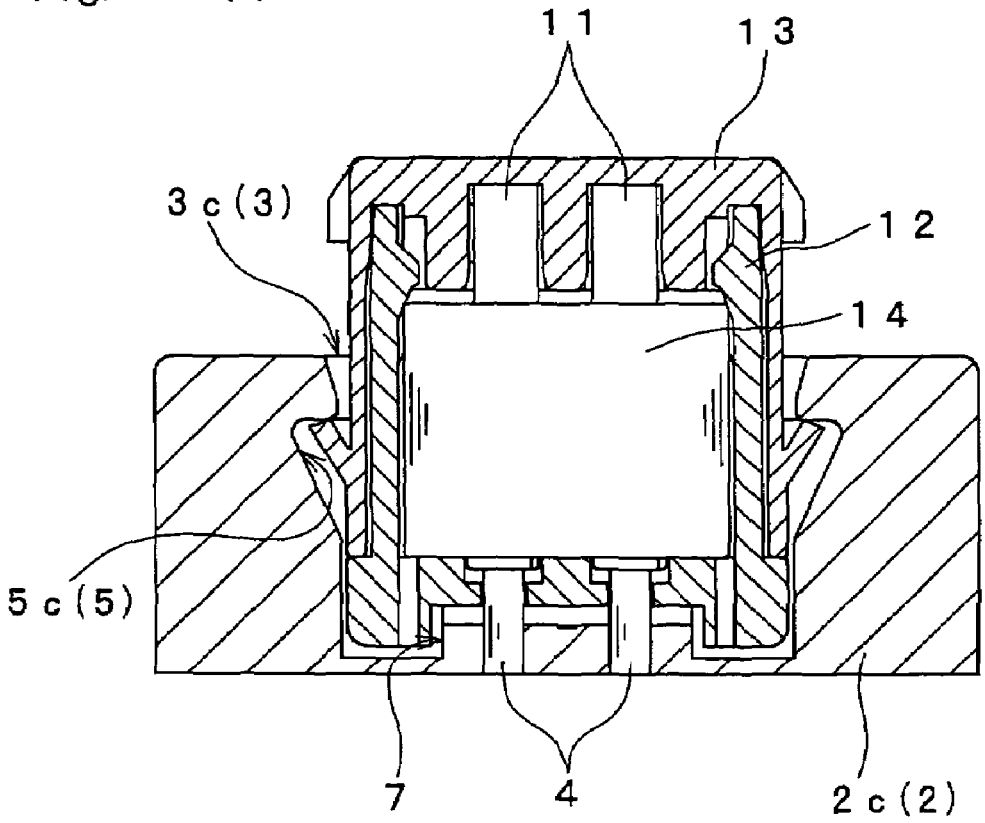
FIG. 14 is a sectional view showing a state in which the electrical connecting device has been connected to the female connector component whose engagement concave is a permanently-set type, and is a plan view of the female connector component.
Figure 14:
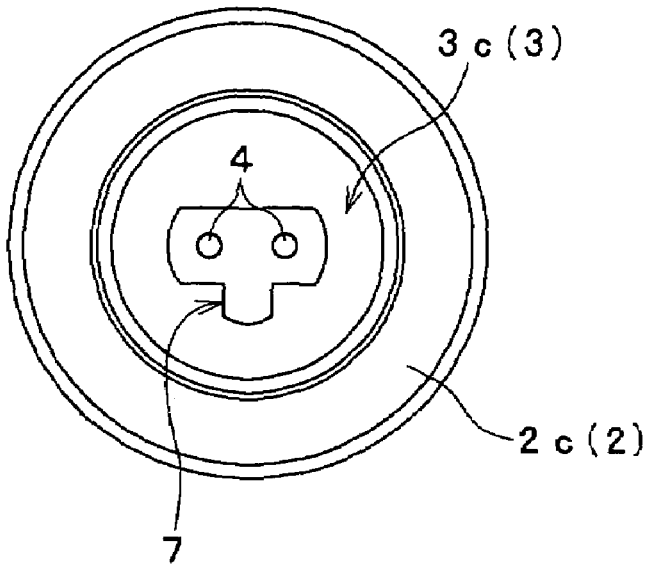

The shape of the female connector component 2 is determined according to a standard. Each of FIG. 12, FIG. 13, and FIG. 14 provides a sectional view ((a) of each figure) showing a state in which the electrical connecting device 1 is connected to the female connector component 2 (2*a*, 2*b*, 2*c*) having each individual standard and a plan view ((b) of each figure) of the female connector component 2 (2*a*, 2*b*, 2*c*). FIG. 12 shows the female connector component 2 having an engagement concave called a trapezoid type, FIG. 13 shows the female connector component 2 having an engagement concave called a rectangle type, and FIG. 14 shows the female connector component 2 having an engagement concave called a permanently-set type. The female connector component 2 (2*a*, 2*b*, 2*c*) has an opening 3 (3*a*, 3*b*, 3*c*) to which the electrical connecting device 1 is fitted (in other words, an opening 3 for receiving the electrical connecting device 1). A pair of to-be-connected terminals (pins) 4 and 4, to which the pair of connecting terminals 11 and 11 are respectively connected, are supported in the opening 3. The shape of the opening 3 varies according to each standard.

Figure 4:
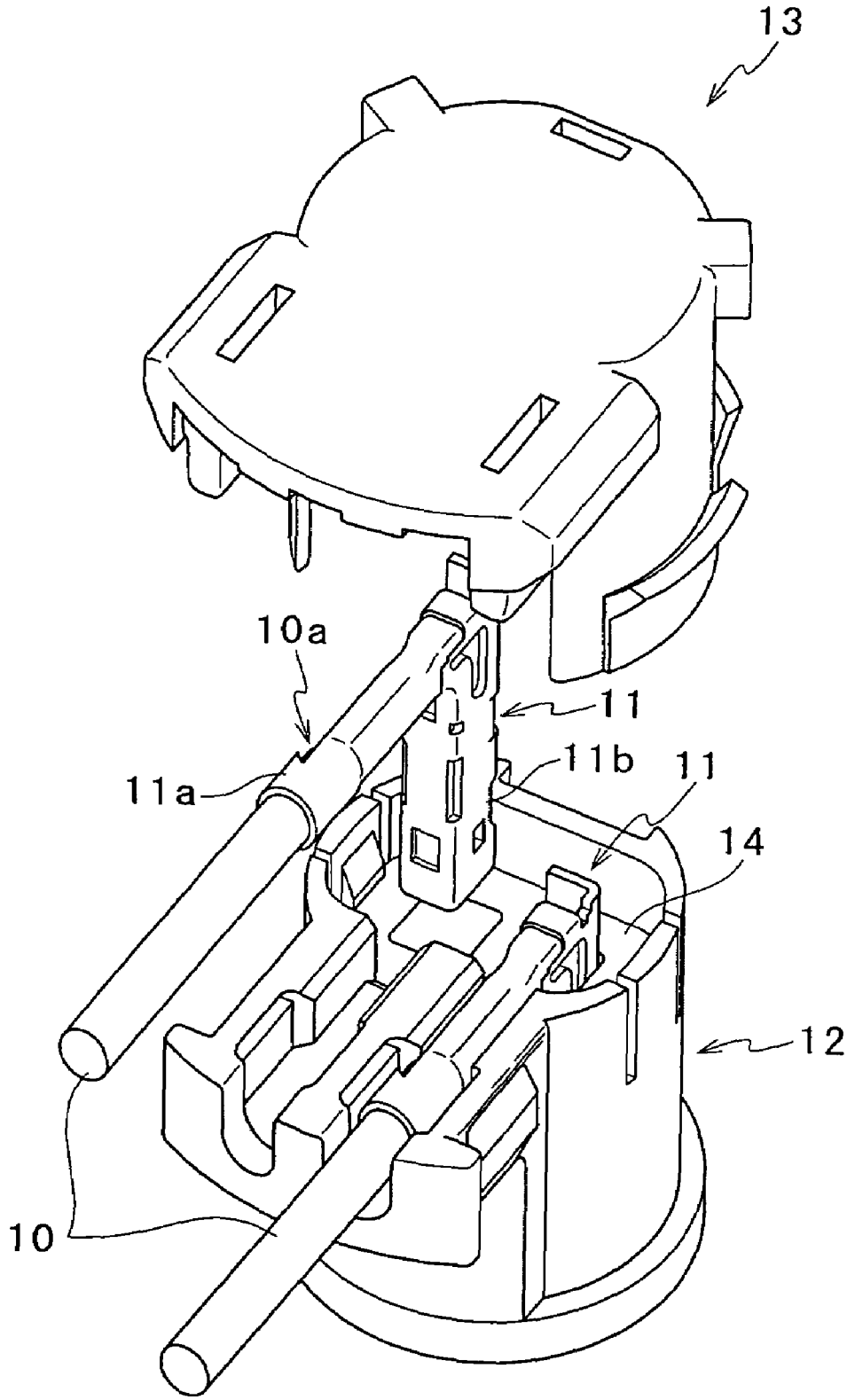
FIG. 4 is an exploded perspective view of the electrical connecting device of FIG. 1.

In FIG. 4, the electrical connecting device 1 includes the pair of connecting terminals 11 and 11, a connector component for connections (plug housing) 12, a cover element (cover housing) 13, and a ferrite member 14. The pair of connecting terminals 11 and 11 are each shaped substantially like the capital letter L, and a lead-wire-side end 11*a* of the connecting terminal 11 is pressed and attached to a naked end part 10*a* provided at an end of a coated lead wire 10. On the other hand, a connection-side end 11*b* of the connecting terminal 11 is inserted into the ferrite member 14, and is connected to the to-be-connected terminal 4 supported by the female connector component 2 by connecting the electrical connecting device 1 to the female connector component 2.

The ferrite member 14 is a member that is incorporated into the electrical connecting device 1 as a means for removing electromagnetic wave noise. In an air bag system constructed in a vehicle, a noise-removing function of the ferrite member 14 can prevent a noise current from flowing to a squib and causing an accidental explosion because of various electromagnetic waves emitted from outside electric wires, from various electronic devices in the vehicle, from radios, or from cellular telephones. The ferrite member 14 has a pair of through-holes into which the connection-side ends 11*b* of the pair of connecting terminals 11 are respectively inserted.

Figure 5:
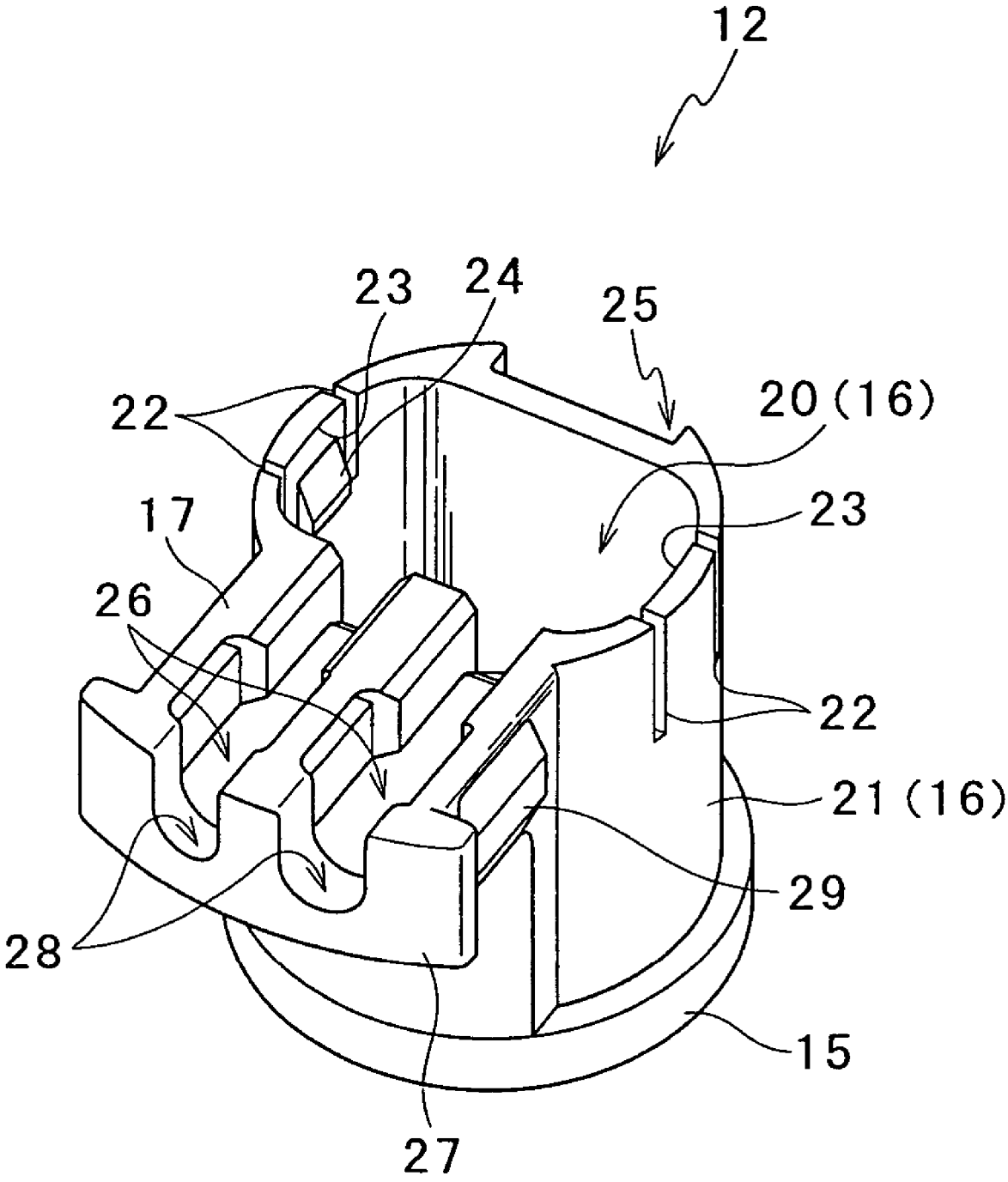
FIG. 5 is a perspective view of a male connector component in the electrical connecting device of FIG. 4.
Figure 6:
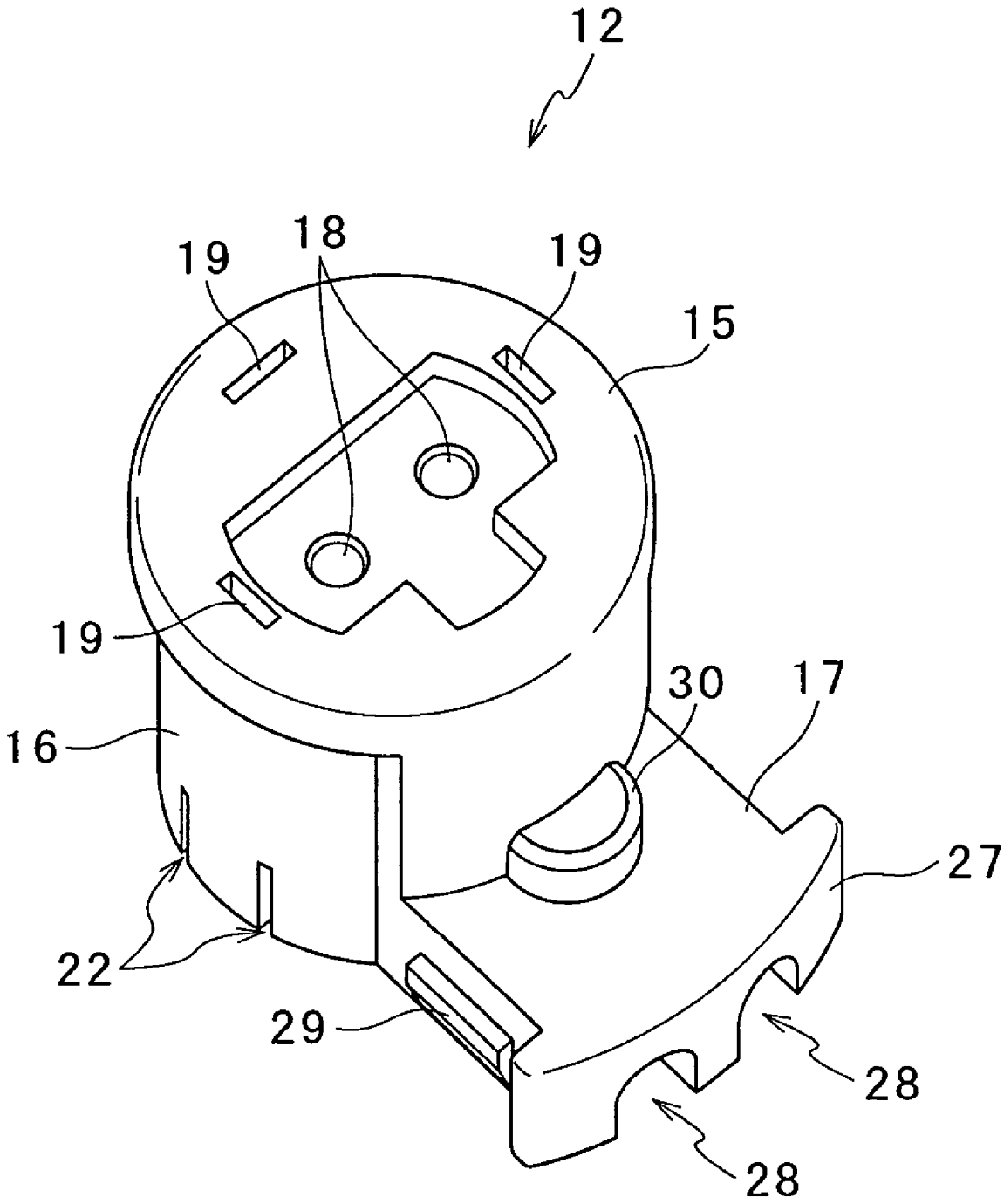
FIG. 6 is a perspective view of the male connector component turned upside down from the state of FIG. 5.

The connector component 12 for connections (hereinafter, referred to as "male connector component 12") is made, for example, of a nonconductive resinous material. The male connector component 12 supports the pair of connecting terminals 11 and 11 and the ferrite member 14, and is fitted to the opening 3 of the female connector component 2. FIG. 5 and FIG. 6 are perspective views of the male connector component 12. FIG. 5 shows the male connector component 12 seen from above, and FIG. 6 shows the male connector component 12 turned upside down from the state of FIG. 5 (i.e., with a bottom thereof upward). As shown in FIG. 5 and FIG. 6, the male connector component 12 has a disk-shaped bottom part 15 provided at the lower side thereof, a substantially cylindrical tube part 16 erected from the bottom part 15, and a projection part 17 that vertically protrudes from the upper part of the tube part 16.

A pair of through-holes 18 and 18 are formed in the bottom part 15. The to-be-connected terminals 4 and 4 are passed through the through-holes 18 and 18, respectively, when the electrical connecting device 1 is fitted to the female connector component 2. A plurality of slits 19 are additionally formed in the bottom part 15. The formation of the slits 19 makes it easy to deform the bottom part 15 and to insert the male connector component 12 when the electrical connecting device 1 is fitted to the opening 3.

A cavity part 20 that contains the ferrite member 14 is formed by a peripheral wall 21 in the tube part 16. At the upper part of the peripheral wall 21, a pair of slits 22 and 22 are formed at two positions that face each other with the cavity part 20 placed therebetween, whereby two flexible parts 23 are formed. The flexible part 23 is provided with a projection 24 so as to hold the ferrite member 14 contained in the cavity part 20. A groove 25 is formed vertically in the peripheral wall 21. This groove 25 is fitted to a streak formed on the cover element 13 when the cover element 13 is fitted.

A pair of terminal supporting parts 26 and 26, to which the lead-wire-side ends 11*a* of the pair of connecting terminals 11 and 11 to be inserted are fitted, are formed on the projection part 17. That is, the lead-wire-side ends 11*a* of the pair of connecting terminals 11 and 11 are supported by the terminal supporting parts 26, and the connection-side ends 11*b* of the pair of connecting terminals 11 and 11 are supported by the through-holes of the ferrite member 14 that is contained in the cavity part 20. Grooves 28 and 28 used to pass the lead wires 10 and 10 are provided at an end 27 of the projection part 17 contiguously to the terminal supporting parts 26 and 26. Engagement convex parts 29 are formed on the projection part 17 at both sides, respectively, in a width direction (i.e., in a direction in which the pair of terminal supporting parts 26 and 26 are arranged). The engagement convex part 29 is engaged with an engagement concave part formed on the side of the cover element 13 when the cover element 13 is fitted to the male connector component 12.

A semi-cylindrical convex part 30 is formed at a root of the projection part 17 joining with the tube part 16 at the lower side of the projection part 17. The convex part 30 is engaged with the opening 3 of the female connector component 2 in a direction in which the male connector component 12 is rotated while being fitted to the female connector component 2 when the male connector component 12 is fitted. The male connector component 12 provided with the convex part 30 is inserted and fitted to the female connector component 2 (2*a*, 2*b*) of an engagement-concave-trapezoid type or of an engagement-concave-rectangle type. As shown in FIG. 12 and FIG. 13, a semicircular concave part 6 (6*a*, 6*b*) that is engaged with the semi-cylindrical convex part 30 is formed at the edge of the opening 3 (3*a*, 3*b*) of the trapezoid type or rectangle type female connector component 2 (2*a*, 2*b*). The convex part 30 and the concave part 6 (6*a*, 6*b*) are engaged with each other in the aforementioned rotational direction in a state in which the pair of connecting terminals 11 and 11 have been properly connected to the pair of to-be-connected terminals 4 and 4 and in which the electrical connecting device 1 has been fitted to the female connector component 2. Therefore, the electrical connecting device 1 can be prevented from being rotated.

Figure 7:
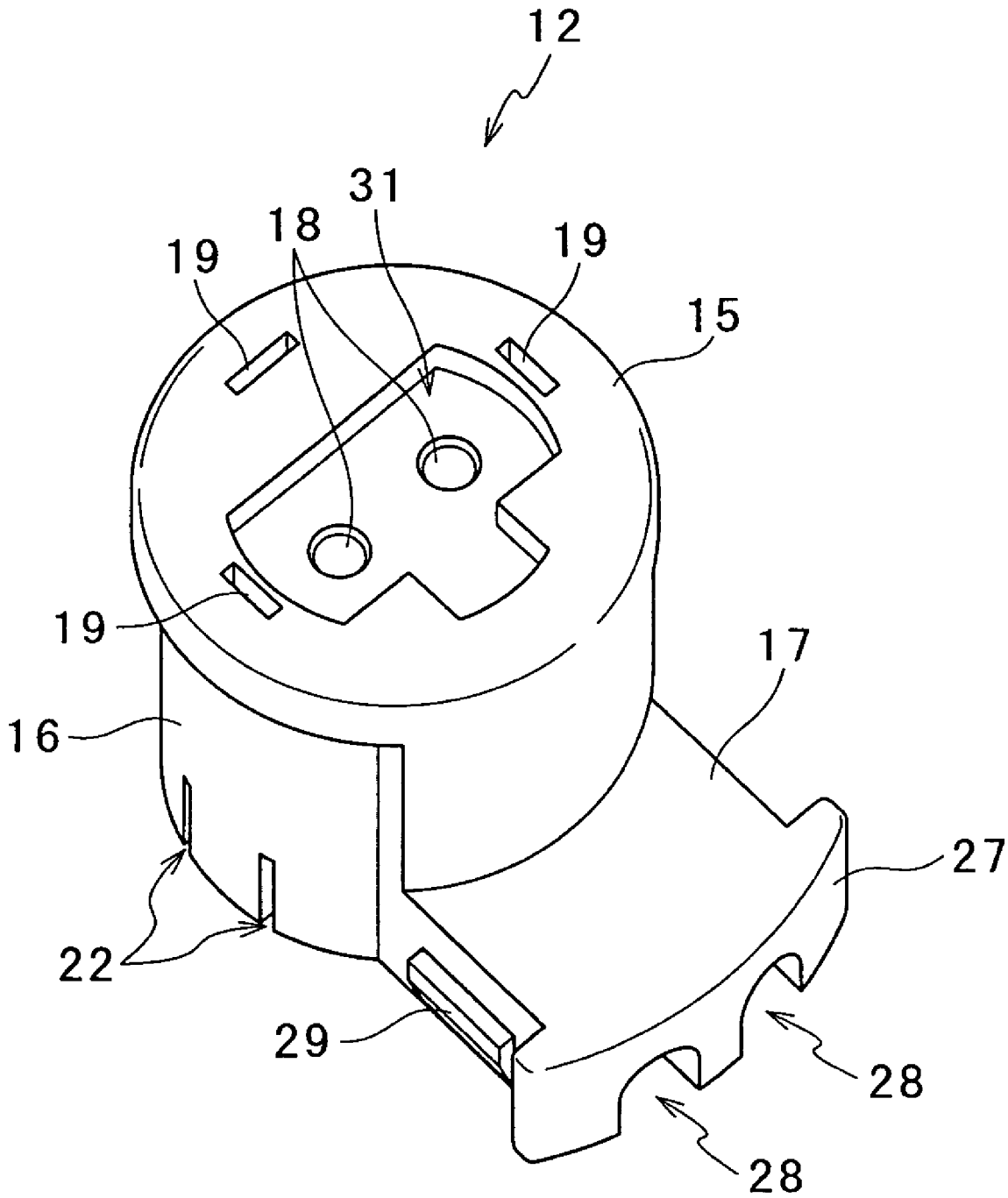
FIG. 7 is a perspective view showing a modification of the male connector component.

An arrangement in which the concave part 31 of FIG. 7 is formed in the male connector component 12 may be used as a mechanism by which the electrical connecting device 1 is prevented from being rotated, instead of the convex part 30. The concave part 31 is formed in the bottom part 15 as a T-shaped concave groove. The male connector component 12 having the concave part 31 is fitted to the female connector component 2 (2*c*) whose engagement concave is a permanently-set type. As shown in FIG. 14, a T-shaped, protruding convex part 7 that is engaged with the T-shaped concave part 31 is formed on the bottom part of the opening 3 (3*c*) of the permanently-set type female connector component 2*c*. In a state in which the electrical connecting device 1 and the female connector component 2 have been properly connected and fitted together, the concave part 31 and the convex part 7 prevent rotation of the electrical connecting device 1.

Figure 8:
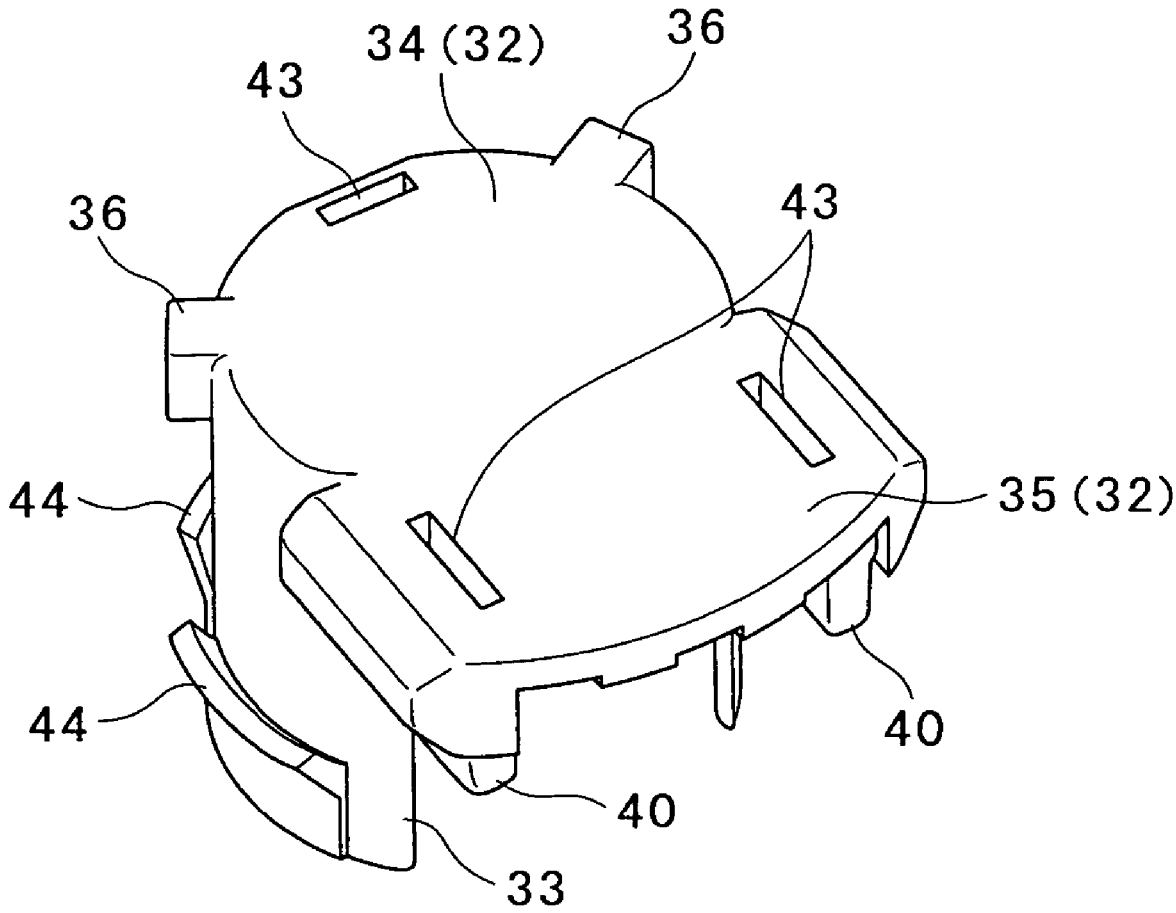
FIG. 8 is a perspective view of a cover element in the electrical connecting device of FIG. 4.
Figure 9:
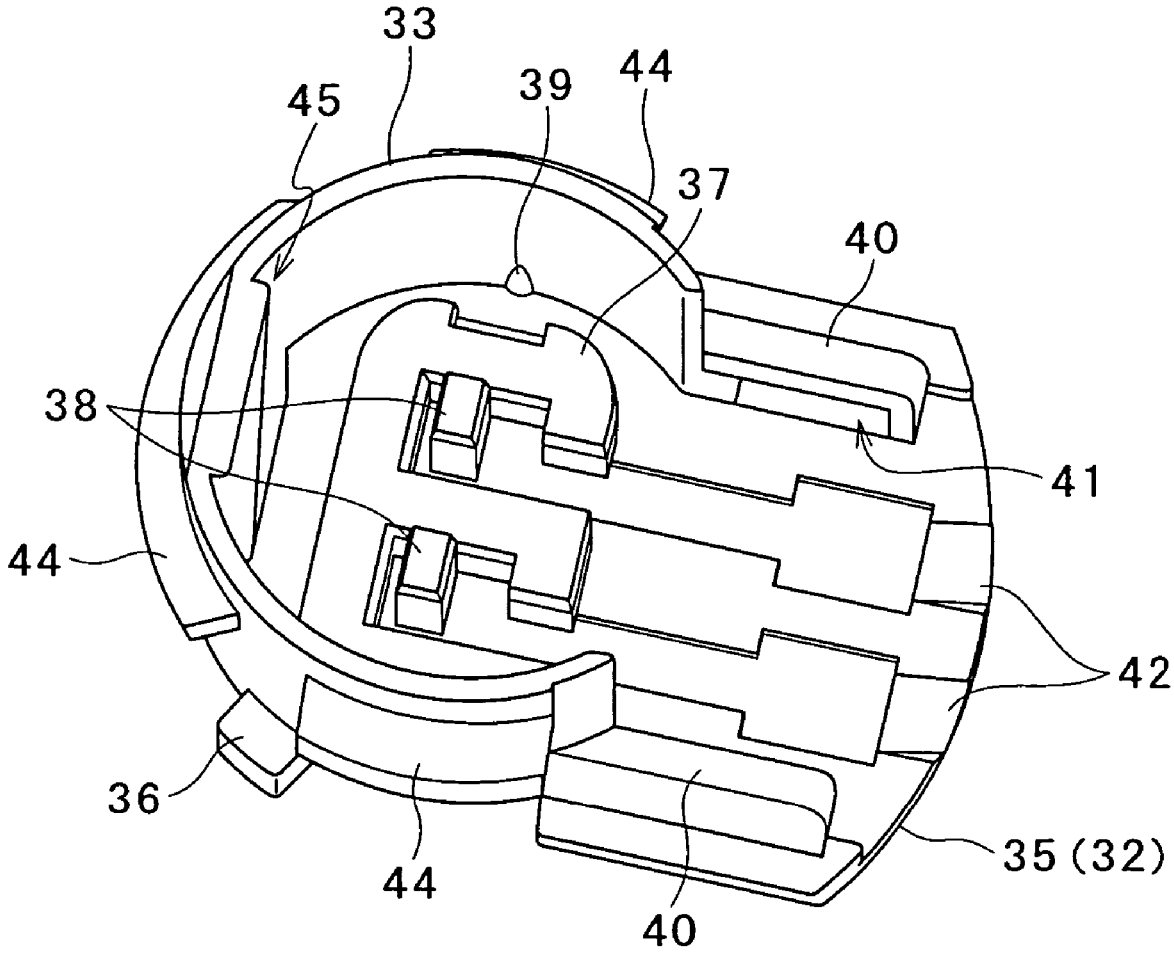
FIG. 9 is a perspective view of the cover element turned upside down from the state of FIG. 8.

The cover element 13 covers an upper opening of the male connector component 12 (i.e., an opening part above the cavity part 20 and the terminal supporting part 26) into which the connecting terminal 11 is inserted. The cover element 13 is fitted to the male connector component 12 in such a way as to sandwich the connecting terminal 11 inserted from the upper opening between the male connector component 12 and the cover element 13 (see FIG. 4). The cover element 13 is made of, for example, a non-conductive resinous material. FIG. 8 and FIG. 9 are perspective views of the cover element 13. FIG. 8 shows the cover element 13 seen from above, and FIG. 9 shows the cover element 13 turned upside down. As shown in FIG. 8 and FIG. 9, the cover element 13 has a lid 32 that is provided at its upper side and with which the aforementioned upper opening is covered and an outer peripheral wall 33 extended from the lid 32 downward.

The lid 32 consists of a front lid part 34 with which the upper opening of the cavity part 20 of the male connector component 12 is covered and a rear lid part 35 with which the upper opening of the terminal supporting part 26 of the male connector component 12 is covered. The front lid part 34 has projections 36 and 36 on both sides, respectively, in the width direction. By providing the projections 36 and 36 on the upper side of the cover element 13 in this way, a check can be easily made as to whether the electrical connecting device 1 and the female connector component 2 have been properly fitted together. In other words, it is possible to easily obtain a confirmation of whether the electrical connecting device 1 and the female connector component 2 have been properly fitted together by placing the finger onto and applying a force onto the projection 36 formed on the upper side of the cover element 13 when the cover element 13 and the male connector component 12 are inserted and fitted to the opening 3 so as to connect the electrical connecting device 1 to the female connector component 2. Additionally, it is possible to easily obtain a confirmation of whether the locking mechanism is properly working between the electrical connecting device 1 and the female connector component 2.

A ferrite pressing part 37, a pair of terminal pressing parts 38 and 38, and ribs 39 are formed on an undersurface of the front lid part 34. The ferrite pressing part 37 is provided at a position that faces the upper part of the ferrite member 14 contained in the cavity part 20 so as to restrict upward and downward movements of the ferrite member 14 in a state in which the cover element 13 is fitted to the male connector component 12. The pair of terminal pressing parts 38 and 38 are provided at positions that face the upper part of each connection-side end 11*b* of the pair of connecting terminals 11 and 11 so as to restrict upward and downward movements of the connecting terminal 11. The ribs 39 are provided at both sides, respectively, in the width direction, and can restrict the movement of the ferrite member 14 by being brought into contact with the flexible parts 23 provided at both sides in the width direction of the male connector component 12.

Projection parts 40 and 40 that protrude from both sides in the width direction downward are formed on the rear lid part 35. The projection part 40 has an engagement concave part 41 that is engaged with the engagement convex part 29 formed on both sides in the width direction of the projection part 17 of the male connector component 12. That is, the cover element 13 is fitted to the male connector component 12 by engaging the engagement convex part 29 with the engagement concave part 41.

A lead wire pressing part 42 is projectively formed on a part corresponding to the groove 28 of the male connector component 12 in the rear lid part 35. The lid 32 has a plurality of slits 43. The formation of these slits 43 makes it easy to deform the lid 32 and to fit the cover element 13 when the electrical connecting device 1 is fitted to the opening 3.

As shown in FIG. 3, the rear lid part 35 of the cover element 13 and the projection part 17 of the male connector component 12 are made short so that the rear lid part 35 and the projection part 17 can be contained within the outer diameter of the female connector component 2 when viewed planarly. As a result, it becomes possible to avoid resistance applied by a blast occurring when the air bag is inflated.

In FIG. 8 and FIG. 9, the outer peripheral wall 33 is extended from the front lid part 34 downward in such a way as to cover the outer periphery of the tube part 16 of the male connector component 12. A convex part 44 that protrudes outward is formed on the outer peripheral wall 33. The convex part 44 is engaged with the concave part provided at the opening 3 when the cover element 13 is fitted to the opening 3 together with the male connector component 12. The convex part 44 is disposed along the periphery of the outer peripheral wall 33, and is contiguously formed at three places, i.e., at both sides in the width direction and at a front side of the cover element 13. The convex part 44 is formed in such a way as to expand toward the upper part of the cover element 13.

A streak 45 extended in upward and downward directions is formed on the front of the inner part of the outer peripheral wall 33. The streak 45 is slid into and fitted to the groove 25 formed on the peripheral wall 21 of the tube part 16 of the male connector component 12 when the cover element 13 is fitted to the male connector component 12.

Figure 10:
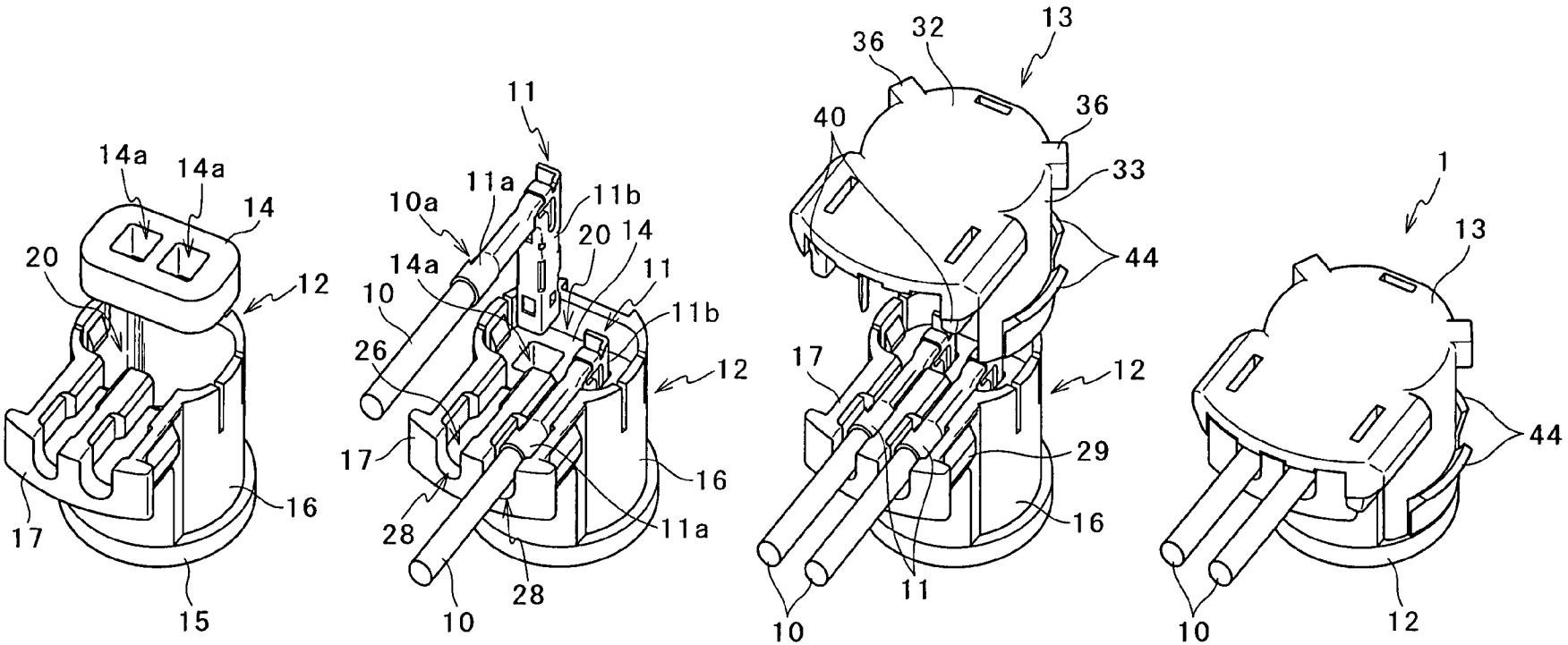
FIG. 10 is a perspective view for explaining an assembly process of the electrical connecting device of FIG. 1.

FIG. 10 is a perspective view for explaining steps for assembling the electrical connecting device 1 from the aforementioned constituent parts. First, the ferrite member 14 is inserted into the cavity part 20 of the tube part 16 in the male connector component 12 as shown in (a) of FIG. 10. The ferrite member 14 inserted in the cavity part 20 is supported by the male connector component 12.

After the ferrite member 14 is supported in the male connector component 12, the pair of connecting terminals 11 in which the lead-wire-side end 11*a* is pressed and attached against the naked end part 10*a* of the lead wire 10 are inserted from the upper opening of the male connector component 12 (i.e., from the opening part above the cavity part 20 and the terminal supporting part 26) as shown in (b) of FIG. 10. At this time, the lead-wire-side end 11*a* of the connecting terminal 11 is contained and supported in the terminal supporting part 26 in such a way as to be fitted thereto. The connection-side end 11*b* of the connecting terminal 11 is then inserted into and supported in the through-hole 14*a* formed in the ferrite member 14.

After the pair of connecting terminals 11 are inserted, the cover element 13 is placed from above the male connector component 12 and is fitted to the male connector component 12 as shown in (c) of FIG. 10. When the cover element 13 is fitted, the outer peripheral wall 33 of the cover element 13 covers the outer periphery of the tube part 16 of the male connector component 12, and the streak 45 of the cover element 13 is fitted to the groove 25 of the male connector component 12 while sliding into the groove 25. The concave part 41 of the projection part 40 formed on both sides in the width direction of the cover element 13 is then engaged with the convex part 29 formed on both sides in the width direction of the projection part 17 of the male connector component 12, whereby the engagement between the cover element 13 and the male connector component 12 is completed. Thus, an assembly of the electrical connecting device 1 shown in (d) of FIG. 10 is obtained.

Figure 11:
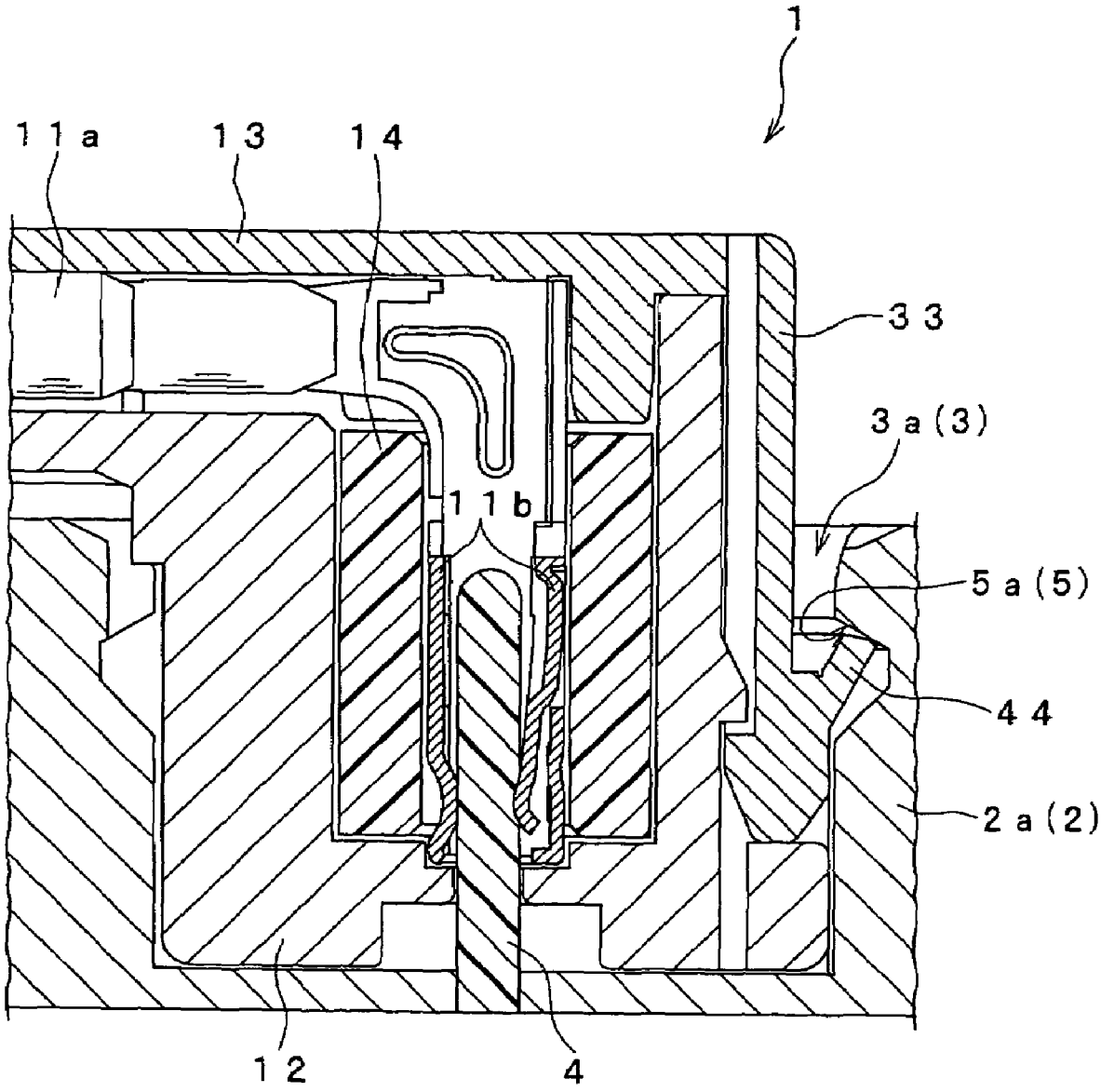
FIG. 11 is a longitudinal sectional view showing a state in which the electrical connecting device of FIG. 1 has been connected to the female connector component.

FIG. 11 is a longitudinal sectional view showing a state in which the electrical connecting device 1 has been connected to the female connector component 2, and is a sectional view in a plane parallel to the connecting terminal 11. The electrical connecting device 1 assembled as described above is fitted to the opening 3 of the female connector component 2. At this time, the convex part 44 formed in such a way as to expand upward comes into contact with the edge of the opening 3, and is temporarily bent inward. The opening 3 has the concave part 5 in the circumferential direction. When the electrical connecting device 1 is inserted deeply into the opening 3, the temporarily bent convex part 44 is moved to the concave part 5, and is engaged with the concave part 5 by the recovery of elasticity. Thereby, a mechanical connection (engagement) between the electrical connecting device 1 and the female connector component 2 is completed. When the engagement therebetween is completed, the pair of to-be-connected terminals 4 on the side of the female connector component 2 are inserted into the connection-side ends 11*b* of the pair of connecting terminals 11 on the side of the electrical connecting device 1, and are brought into contact with the connection-side ends 11*b*, respectively, so as to reach a state in which an electric current can be applied to the squib (i.e., reach an electrically connected state).

FIG. 11 is a sectional view of the electrical connecting device 1 connected to the female connector component 2*a* whose engagement concave is a trapezoid type (see FIG. 12), and, in a case in which its engagement concave is a rectangle type (see FIG. 13) or a permanently-set type (see FIG. 14), the concave part 5 (5*b*, 5*c*) of the cover element 13 is engaged with the concave part 5 (5*b*, 5*c*) of the female connector component 2 (2*b*, 2*c*) in the same way as in the trapezoid type. As shown in FIG. 12 to FIG. 14, the concave part 5*a* is sectionally shaped like a trapezoid in the trapezoid type, the concave part 5*b* is sectionally shaped like a rectangle in the rectangle type, and the concave part 5*c* is sectionally shaped like a triangle in the permanently-set type. However, as shown in FIG. 12 to FIG. 14, the convex part 44 of the cover element 13 can be properly engaged with the concave part 5 even if the female connector component 2 belongs to any one of these types.

According to the electrical connecting device 1 described above, since the convex part 44 of the cover element 13 is engaged with the concave part 5 of the opening 3 of the female connector component 2, the cover element 13 is mechanically locked to the female connector component 2, and is not easily disengaged therefrom even when an external force acts thereon. Additionally, since the cover element 13 with which the upper opening of the male connector component 12 is covered and the female connector component 2 are locked together, a state is reached in which the male connector component 12 and the cover element 13 are both locked to the female connector component 2. Therefore, it is possible to obtain an electrical connecting device in which the cover element 13 is not easily disengaged even when an external force acts thereon and in which the male connector component 12 and the cover element 13 are firmly held by the female connector component 2.

Additionally, according to the electrical connecting device 1, since the convex part 44 that is engaged with the concave part 5 is disposed along the periphery of the outer peripheral wall 33, the cover element 13 is stably locked to the female connector component 2 independently of a direction in which an external force acts. Additionally, the convex part 44 that is engaged with the concave part 5 can be easily formed by providing the outer peripheral wall 33 that is constructed downward so as to cover the outer periphery of the male connector component 12.

Additionally, according to the electrical connecting device 1, since the convex part 44 is formed in such a way as to expand upward, it is possible to realize a structure in which the cover element 13 can be easily fitted to the opening 3 together with the male connector component 12 and in which the convex part 44 that has been fitted and engaged with the concave part 5 is not easily disengaged therefrom.

Although the present invention has been described with respect to the preferred embodiments, it is intended that alternatives, modifications, and equivalents within the scope of the appended claims, from which these will be clarified by reading and understanding this description as a matter of course, are all included in the scope of the present invention.

For example, the present invention can be embodied to have the following changes.

The convex part does not necessarily need to be shaped as in the embodiment. For example, the convex part does not need to be disposed along the periphery of the outer peripheral wall. Additionally, the convex part does not need to expand toward the upper part of the cover element.

Additionally, it is permissible that the projection provided on the side of the upper part of the cover element has a shape differing from that of the embodiment or is disposed at a position differing from that of the embodiment. Additionally, the projection does not need to be provided.

Additionally, the concave part or the convex part used to prevent the rotation does not need to be provided.

INDUSTRIAL APPLICABILITY

As is apparent from the foregoing description, the electrical connecting device of the present invention is suitable to be applied as an electrical connecting device especially for a squib that is ignited by applying an electric current to a gas generator in an air bag system for vehicles. However, the electrical connecting device can be applied more widely, and can be applied in many different environments and for various objects.

What is claimed is:

1. An electrical connecting device for connecting a female connector component, comprising:

a pair of connecting terminals configured to be electrically connected to a pair of to-be-connected terminals of the female connector component;

a male connector component having a peripheral wall forming a cavity and configured to support the pair of connecting terminals, wherein the male connector component accommodates a ferrite member in the cavity thereof, and wherein the peripheral wall of the male connector component comprises a pair of flexible parts to restrain movement of the ferrite member; and a cover element configured to be attached to the male connector component to cover the pair of connecting terminals and having an outer peripheral wall adapted for fitting the peripheral wall of the male connector component, wherein the cover element comprises a latching part configured to engage with a recess formed in an opening of the female connector component when the cover element is fitted into the opening together with the male connector component.

2. The electrical connecting device as set forth in claim 1, wherein the latching part is disposed on an outer surface of the outer peripheral wall.

3. The electrical connecting device as set forth in claim 1, wherein the latching part is configured to expand toward an upper part of the cover element.

4. The electrical connecting device as set forth in claim 1, wherein the cover element has a projection disposed on the upper part thereof.

5. The electrical connecting device as set forth in claim 1, wherein the male connector component comprises a protrusion disposed on a lower part thereof, wherein the protrusion configured to fit into a complementary depression of the female connector component to restrain rotational movement of the male connector component with respect to the female connector component.

6. The electrical connecting device as set forth in claim 1, wherein the male connector component includes a tube part, wherein a portion of the tube part is formed by the peripheral wall.

7. The electrical connecting device as set forth in claim 6, wherein the male connector component comprises a depression disposed on a lower part thereof, wherein the depression configured to fit a complementary protrusion of the female connector component therein to restrain rotational movement of the male connector component with respect to the female connector component.

8. The electrical connecting device as set forth in claim 1, wherein the cover element comprises a rib configured to interfere with the flexible parts.

9. The electrical connecting device as set forth in claim 6, wherein the male connector component includes a ledge part laterally extending from and integrally connected to the tube part.

10. The electrical connecting device as set forth in claim 9, wherein dimensions of the male connector fall within dimensions of the female connector component.

* * * * *